US007417592B1

(12) United States Patent
Hsiao et al.

(10) Patent No.: US 7,417,592 B1
(45) Date of Patent: Aug. 26, 2008

(54) PORTABLE AUDIO WIRELESS COMMUNICATION DEVICE

(75) Inventors: Lan-Yung Hsiao, Taipei Hsien (TW); Kai Shih, Taipei Hsien (TW); Yu-Yuan Wu, Taipei Hsien (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 47 days.

(21) Appl. No.: 11/679,721

(22) Filed: Feb. 27, 2007

(51) Int. Cl.
*H01Q 1/24* (2006.01)
*H01Q 1/50* (2006.01)

(52) U.S. Cl. ..... 343/702; 343/906; 343/905

(58) Field of Classification Search ..... 343/905, 343/906

See application file for complete search history.

(56) References Cited

U.S. PATENT DOCUMENTS 4,864,318 A * 9/1989 Iwasaki et al. ..... 343/720
5,701,356 A * 12/1997 Stanford et al. ..... 381/385
2005/0285799 A1* 12/2005 Leinonen et al. ..... 343/702
2008/0007276 A1* 1/2008 Tse et al. ..... 324/699

* cited by examiner

*Primary Examiner*—Trinh V Dinh
(74) *Attorney, Agent, or Firm*—WPAT, P.C.; Anthony King

(57) ABSTRACT

A portable audio wireless communication device cooperating with a portable electrical apparatus with a display component has a plug for matting with the portable electrical apparatus, a speaker and a cable connected the plug and the speaker. The plug has a signal contact connected one end of a signal wire of the cable, a ground contact connected one end of a matching antenna wire of the cable, a first antenna contact connected one end of a first antenna wire and one end of the matching antenna, and a second antenna contact connected one end of the second antenna of the cable. When the portable audio wireless communication device operates at wireless communication, cooperation of the first antenna wire and the matching antenna wire resonates at UHF broadcast band, and the second antenna wire resonates at FM broadcast band and VHF broadcast band.

8 Claims, 3 Drawing Sheets

PORTABLE AUDIO WIRELESS COMMUNICATION DEVICE

BACKGROUND OF THE INVENTION

1. Field of the Invention

The invention relates to a portable audio wireless communication device, and particularly to a portable audio wireless communication device capable of receiving wireless broadcast and cooperating with an apparatus with a display component.

2. The Related Art

In early stages, people listen in to music through audio broadcast such as frequency modulation (FM) broadcast and amplitude modulation (AM) broadcast. Recently, people watch television programs on high definition television (HDTV) through video broadcast such as very high frequency (VHF) and ultra high frequency (UHF) broadcast.

A conventional broadcast receiver capable of receiving various broadcasts is configured in an auto motor. So an antenna cooperated with the conventional broadcast receiver has large volume, which is also configured in the auto motor. According to development of display technology and wireless communication technology, a portable electrical apparatus with a display device such as a mobile phone, a personal digital assistant, etc is equipped with the function for processing audio and video broadcast signal which is received from various broadcast bands, and then outputting audio through a speaker and video through the display device. Therefore, it is necessary that an antenna has small volume capable of cooperating with the portable electrical apparatus.

SUMMARY OF THE INVENTION

An object of the present invention is to provide a portable audio wireless communication device with small volume capable of operating at various broadcast bands and cooperating with a portable electrical apparatus with a display component.

According to the invention, the portable audio wireless communication device has a plug, a speaker and a cable connected the plug and the speaker. The plug electronically coupled with the portable electrical apparatus has a signal contact, a ground contact, a first antenna contact and a second antenna contact. The cable has insulation material which shields a signal wire, a first antenna wire, a matching antenna wire and a second antenna wire. The signal wire electronically connects to the signal contact of the plug and the speaker. One end of the first antenna wire electronically connects to the first antenna contact of the plug. One end of the matching antenna wire electronically connects to the ground contact and the first antenna contact of the plug. One end of the second antenna wire electronically connects to the second antenna contact of the plug.

When the portable audio wireless communication device operates at wireless communication, cooperation of the first antenna wire and the matching antenna wire resonates at UHF broadcast band and the second antenna wire resonates at FM broadcast band and VHF broadcast band.

Therefore, the speaker of the portable audio wireless communication device transforms audio signal which is carried on FM, UHF and VHF broadcast bands and received through the portable audio wireless communication device to sound and outputs the sound. The display component of the portable electrical apparatus displays images which are transformed from video signal carried on UHF and VHF broadcast bands and received through the portable audio wireless communication device.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
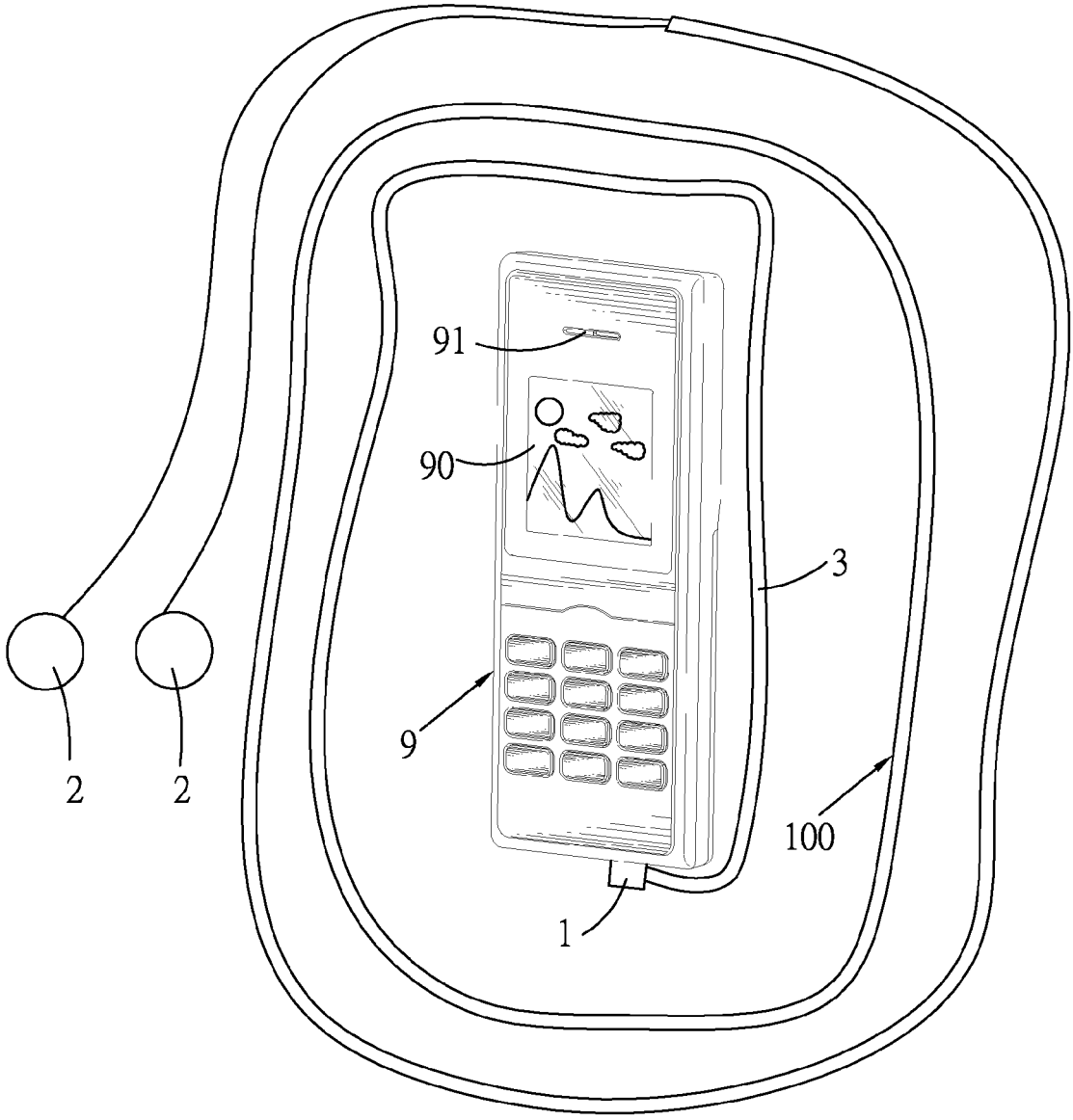
FIG. 1 shows the cooperation of a portable electrical apparatus and a portable audio wireless communication device according to the present invention.

Please refer to FIG. 1, which shows cooperation of a portable audio wireless communication device 100 and a portable electrical apparatus 9 with a display component 90. In this embodiment, the portable electrical apparatus 9 is a mobile phone.

Figure 2:
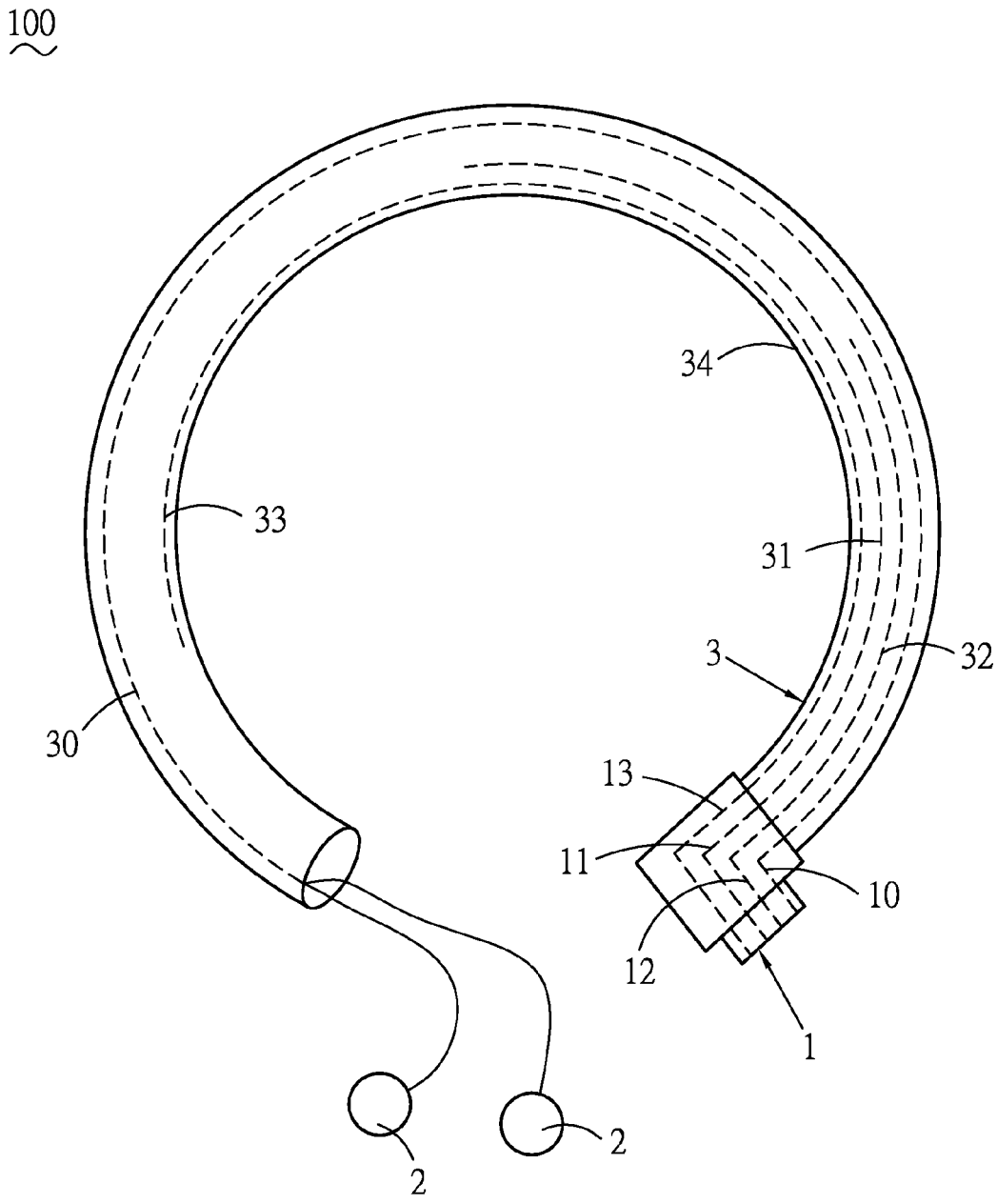
FIG. 2 illustrates a first preferred embodiment of the portable audio wireless communication device according to the present invention.

Please refer to FIG. 2, which illustrates a first preferred embodiment of the portable audio wireless communication device 100 having a plug 1 for mating with a connector of the portable electrical apparatus 9 (shown in FIG. 1), a speaker 2 and a cable 3 connected to the plug 1 and the speaker 2. In this case, the portable audio wireless communication device 100 is equiped with a pair of speakers 2. The plug 1 has a signal contact 10, a first antenna contact 11, a ground contact 12 and a second antenna contact 13 for being electronically coupled with the connector of the portable electrical apparatus 9.

The cable 3 has a signal wire 30, a first antenna wire 31, a matching antenna wire 32, a second antenna wire 33 and insulation material 34 shielding the signal wire 30 and the antenna wires 31, 32, 33. One end of the signal wire 30 electronically connects to the signal contact 10 of the plug 1, the other end of the signal wire 30 electronically connects to the speaker 2 for transmitting audio signal. One end of the first antenna wire 31 electronically connects to the first antenna contact 11 of the plug 1. One end of the matching antenna wire 32 electronically connects to the ground contact 12 and the first antenna contact 11 of the plug 1. One end of the second antenna wire 33 electronically connects to the second antenna contact 13 of the plug 1.

Still referring to FIG. 2, in this case, the first antenna wire 31 obtains an electrical resonance length of three-fourths wavelength corresponding to UHF broadcast band, and the matching antenna wire 32 obtains an electrical resonance length of a quarter wavelength corresponding to UHF broadcast band. In this case, the first antenna wire 31 and the matching antenna wire 32 are formed to J-type antenna. The second antenna wire 33 obtains an electrical resonance length of a quarter wavelength corresponding to FM broadcast band and VHF broadcast band. In this case, the second antenna wire 33 is a monopole antenna.

When the portable audio wireless communication device 100 cooperates with the portable electrical apparatus 9, the plug 1 of the portable audio wireless communication device 100 mates with the connector of the portable electrical apparatus 9 and the ground contact 12 of the plug 1 electronically connects to the ground of the portable electrical apparatus 9. The current is transmitted from the portable electrical apparatus 9 and passed through the plug 1 of the portable audio wireless communication device 100 and then respectively fed to the first antenna wire 31, the matching antenna wire 32 and the second antenna wire 33. Therefore, the cooperation of the first antenna wire 31 and the matching antenna wire 32 resonates at UHF broadcast band, and the second antenna wire 33 resonates at FM and VHF broadcast bands.

Figure 3:
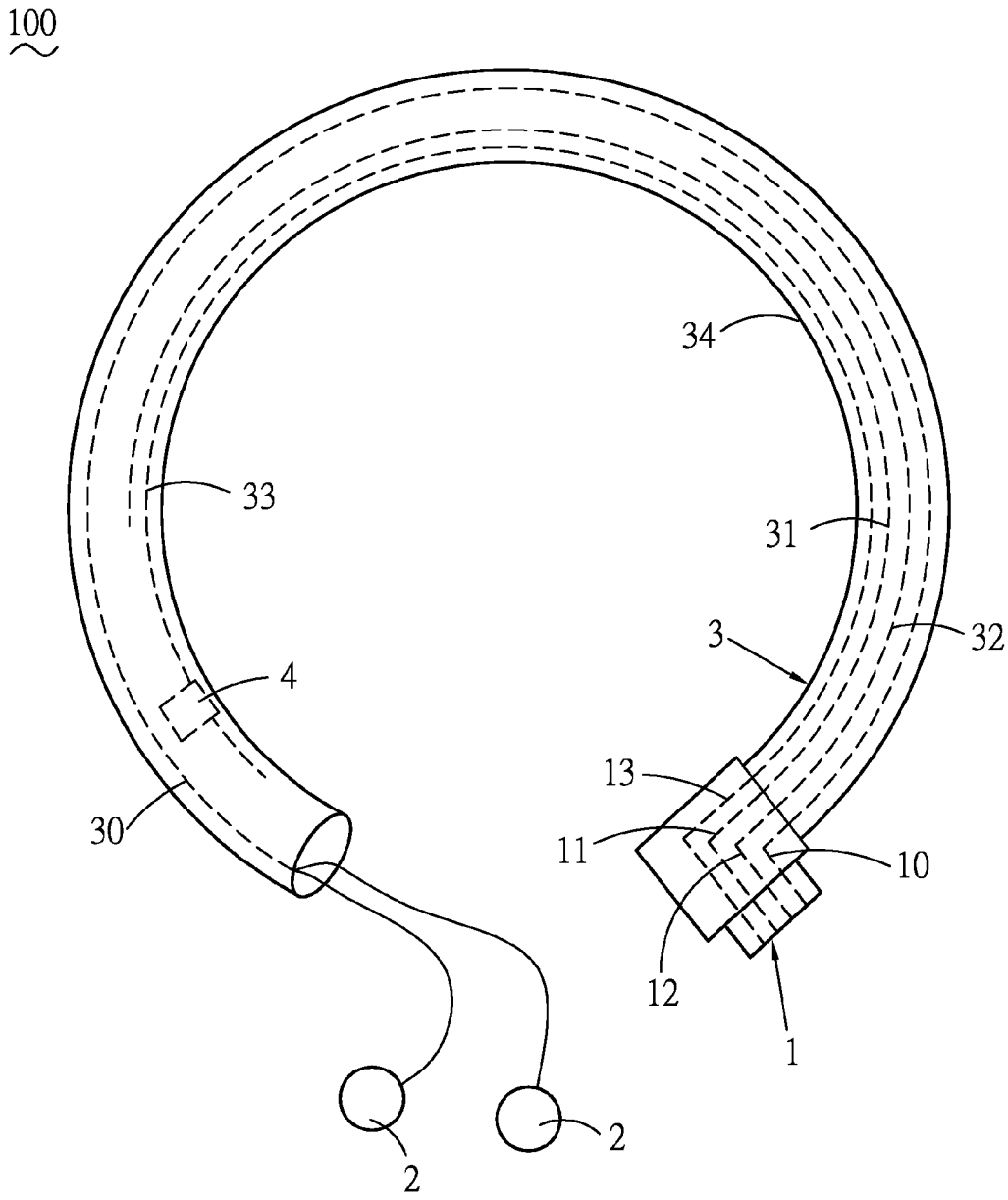
FIG. 3 shows a second preferred embodiment of the portable audio wireless communication device according to the present invention.

Please refer to FIG. 3, which shows a second preferred embodiment of the portable audio wireless communication device 100. In this case, the portable audio wireless communication device 100 has a matching circuit 4 connected in serial with said second antenna wire 33 for adjusting electrical characteristic of the second antenna wire 33. Therefore, the cooperation of the second antenna wire 33 and the matching circuit 4 resonates a preferred bandwidth including FM and VHF broadcast bands. The matching current 4 can be capacitance or inductance or consist of capacitance and inductance.

Because the first antenna wire 31, the matching antenna wire 32 and the second antenna wire 33 are contained in the cable 3 of the portable audio wireless communication device 100, the portable audio wireless communication device 100 has a small volume for being carried. The speaker 2 of the portable audio wireless communication device 100 transforms audio signal which is carried on UHF, VHF and FM broadcast bands and received through the portable audio wireless communication device 100 to sound and outputs the sound. The display component 90 of the portable electrical apparatus 9 displays images which are transformed from video signal carried on UHF and VHF broadcast bands and received through the portable audio wireless communication device 100.

Moreover, the speaker 91 of the portable electrical apparatus 9 can also transform audio signal which is carried on UHF, VHF and FM broadcast bands and received through the portable audio wireless communication device 100 to sound and output the sound.

Furthermore, the present invention is not limited to the embodiments described above; various additions, alterations and the like may be made within the scope of the present invention by a person skilled in the art. For example, respective embodiments may be appropriately combined.

What is claimed is:

1. A portable audio wireless communication device which cooperates with a portable electrical apparatus with a display component, comprising:

a plug having a signal contact, a ground contact, a first antenna contact and a second antenna contact for being electronically coupled with said portable electrical apparatus;

at least a speaker for transforming audio signal to sound and outputting said sound; and a cable connected to said plug and said speaker, which has a signal wire, a first antenna wire, a matching antenna wire, a second antenna wire and insulation material shielding said signal wire and said antenna wires;

wherein the signal wire is electronically connected to said signal contact of said plug and said speaker for transmitting audio signal, one end of said first antenna wire is electronically connected to said first antenna contact of said plug, one end of said matching antenna wire is electronically connected to said ground contact and said first antenna contact of said plug, one end of said second antenna wire is electronically connected to said second antenna contact of said plug, said first antenna wire and said matching antenna wire are resonated at ultra high frequency broadcast band, said second antenna wire is resonated at frequency modulation broadcast band and very high frequency broadcast band.

2. The portable audio wireless communication device as claimed in claim 1, further comprising a matching circuit connected in serial with said second antenna wire.

3. The portable audio wireless communication device as claimed in claim 1, wherein said portable electrical apparatus is a mobile phone.

4. The portable audio wireless communication device as claimed in claim 1, wherein said first antenna wire obtains an electrical resonance length of three-fourths wavelength corresponding to ultra high frequency broadcast band, said matching antenna wire obtains an electrical resonance length of a quarter wavelength corresponding to ultra high frequency broadcast band.

5. The portable audio wireless communication device as claimed in claim 4, wherein said first antenna wire and said matching antenna wire are formed to J-type antenna.

6. The portable audio wireless communication device as claimed in claim 1, wherein said second antenna wire obtains an electrical resonance length of a quarter wavelength corresponding to frequency modulation broadcast band and very high frequency band.

7. The portable audio wireless communication device as claimed in claim 6, wherein said second antenna wire is a monopole antenna.

8. The portable audio wireless communication device as claimed in claim 1, wherein said ground contact of said plug is electronically connected to the ground of said portable electrical apparatus.

* * * * *